US006185532B1

(12) United States Patent
Lemaire et al.

(10) Patent No.: US 6,185,532 B1
(45) Date of Patent: Feb. 6, 2001

(54) DIGITAL BROADCAST SYSTEM WITH SELECTION OF ITEMS AT EACH RECEIVER VIA INDIVIDUAL USER PROFILES AND VOICE READOUT OF SELECTED ITEMS

(75) Inventors: Charles Arthur Lemaire; Bryan Lester Striemer, both of Zumbrota, MN (US)

(73) Assignee: International Business Machines Corporation, Armonk, NY (US)

( * ) Notice: Under 35 U.S.C. 154(b), the term of this patent shall be extended for 1274 days.

(21) Appl. No.: 08/584,726

(22) Filed: Jan. 11, 1996

Related U.S. Application Data

(63) Continuation of application No. 07/993,163, filed on Dec. 18, 1992, now abandoned.

(51) Int. Cl.[7] ..... G10L 13/08

(52) U.S. Cl. ..... 704/258; 379/88.16

(58) Field of Search ..... 395/2, 2.1, 2.67, 395/2.69, 2.79, 2.8, 2.81; 381/41.53; 340/825.27, 825.44; 434/116; 704/201, 258, 270; 379/88.16

(56) References Cited

U.S. PATENT DOCUMENTS

| | | | | |
|---|---|---|---|---|
| 4,479,124 | * | 10/1984 | Rodriguez et al. | 395/2 |
| 4,602,279 | * | 7/1986 | Freeman | 358/86 |
| 4,692,941 | * | 9/1987 | Jacks et al. | 381/52 |
| 4,694,494 | * | 9/1987 | Woolfson | 395/2.8 |
| 4,742,516 | | 5/1988 | Yamaguchi | 370/94 |
| 4,887,308 | * | 12/1989 | Dutton | 455/186 |
| 4,949,085 | * | 8/1990 | Fisch et al. | 340/825.44 |
| 5,020,107 | * | 5/1991 | Rohani et al. | 381/43 |
| 5,025,252 | * | 6/1991 | DeLuca et al. | 340/825.27 |
| 5,049,874 | * | 9/1991 | Ishida et al. | 340/825.27 |
| 5,131,020 | * | 7/1992 | Liebesny et al. | 379/59 |
| 5,146,216 | * | 9/1992 | DeLuca et al. | 340/825.27 |
| 5,146,538 | * | 9/1992 | Sobti et al. | 395/2 |
| 5,153,579 | * | 10/1992 | Fisch et al. | 340/825.44 |
| 5,170,490 | * | 12/1992 | Cannon et al. | 395/2 |
| 5,214,792 | * | 5/1993 | Alwadish | 455/186 |
| 5,258,751 | * | 11/1993 | DeLuca et al. | 340/825.44 |
| 5,281,962 | * | 1/1994 | Vanden Heuvel et al. | 340/825.27 |
| 5,359,698 | * | 10/1994 | Goldberg et al. | 395/2.79 |

FOREIGN PATENT DOCUMENTS

| | | | |
|---|---|---|---|
| 62-35835 | 10/1987 | (JP) | H04H/1/00 |
| 3106673 | * 5/1991 | (JP) . | |

OTHER PUBLICATIONS

T. Parsons, "Voice and Speech Processing," 1987, pp. 92–94, 281–288.*

Berkeley Speech Technologies, Inc., 2409 Telegraph Ave., Berkeley,CA 94704 "Computer Speech Delivers Messages On The Road—the BeSTspeech Dataspeaker", and"FAXes by Phone—New Patent for Fax–to–Speech Conversion System", Nov. 1990, pp. 1–3.

Ad for QuoTrek 5.0 found in Kiplingers's Personal Finance Magazine, Sep. 1992, p. 123.

"Information Generation Spawns Computer Junkies", PC Week, May 13, 1992, p. 62, Cheryl Currid.

* cited by examiner

*Primary Examiner*—David R. Hudspeth
*Assistant Examiner*—Martin Lerner
(74) *Attorney, Agent, or Firm*—J. Michael Anglin; Felsman, Bradley, Vaden, Gunter & Dillon

(57) ABSTRACT

A communications system includes a single transmitter and a large number of individual receivers. The transmitter broadcasts a signal over a medium a continuous stream of digitally coded text items, each carrying information as to one or more subjects described by an index term. Each receiver includes a demodulator for continuously receiving the broadcast signal, a profile storage tailorable by each user individually to contain a list of desired index terms, means for selecting only those items having index terms matching those in the profile storage, and a memory for storing the selected items. The user can activate the receiver to play back items in the memory and to choose among the stored items. The items chosen for playback are converted from digital text to a synthesized voice, which is sent as an audio signal to the user.

34 Claims, 6 Drawing Sheets

DIGITAL BROADCAST SYSTEM WITH SELECTION OF ITEMS AT EACH RECEIVER VIA INDIVIDUAL USER PROFILES AND VOICE READOUT OF SELECTED ITEMS

This is a continuation of application Ser. No. 07/993,163, filed Dec. 18, 1992, now abandoned.

BACKGROUND OF THE INVENTION

The present invention relates to broadcast communications systems, and more specifically concerns such systems in which each receiver in such systems can personalize the received information to his own requirements.

A conventional radio news or other information broadcast contemplates a single stream of news items spoken by a newscaster and simultaneously received by thousands of listeners. The newscaster must attempt to transmit items which are of interest to the maximum number of listeners in the limited time available. The listeners for their part must attend to many items which are of no interest to them personally in order to catch the relatively few which are of interest. Additionally, the listeners must be available at the time the items are transmitted; delayed listening via recording is not very practical. The analog voice nature of radio broadcasts also makes them rather wasteful of scarce spectrum resources.

Some recent information services attempt to get around one or more of these limitations. News items are available in stored digital form to subscribers of facilities such as Prodigy(R) interactive personal service. Other services even scan news wires for selected topics, then clip them automatically into folders for a recipient. Although such items can be accessed at any convenient time, these services require the recipient to be located at a computer terminal connected to the service, and the visual presentation requires enough of his attention that little other simultaneous activity is possible. Even more recently, specialized portable terminals receive broadcasts of digital information items such as stock-market quotes, for display on a small screen.

Solutions to the above problems still fall short in many respects. The recipient is tied to a computer terminal, must read a display, or attend to all items being broadcast. A large number of people who need current information on a relatively small number of topics could benefit greatly from a service using the paradigm of a radio news broadcast which can be individually tailored to each listener's specific interests, and which can be listened to at any time convenient to them.

SUMMARY OF THE INVENTION

The present invention provides apparatus and methods for personalizing or tailoring the contents of a system for reception of broadcast news or similar text items to the specific requirements of each individual user of the system. (The term "broadcast" in this context refers to the transmission of a signal from one location to a number of separate receiving locations which are not fixed or even known to the transmitter.) The information items can be listened to at any convenient time, regardless of the actual time of transmission. They can be skipped, repeated, erased, and otherwise manipulated; these operations can be performed in an easy, intuitive way using controls already familiar to most users. Because the items are presented aurally rather than visually, driving, walking, or other activities can be engaged in while the user listens to the information. Receiver units can be made physically small enough that they can be carried about on the user's person in the same manner as today's personal tape player/radios. These units can also be fitted in cars or other locations not now normally used for receiving such specialized information. Because each receiver is individually programmed to continuously and selectively store only the information of interest to one user, and the user may retrieve the information at any convenient time, broadcast companies need not guess as to the topics or times to transmit.

Broadly, such a communications system includes a single transmitter and a large number of individual receivers. The transmitter broadcasts a signal over a medium a continuous stream of coded text items, each carrying information as to one or more subjects described by an index term. Each receiver includes a detector for continuously receiving the broadcast signal, a profile storage tailorable by each user individually to contain a list of desired index terms, a filter for selecting only those items having index terms matching those in the profile storage, and a memory for storing the selected items. The user can activate the receiver to play back items in the memory, to choose among the stored items, and to erase them, freeing space for future items. The items chosen for playback are converted from digital text to a synthesized voice, which is sent as an audio signal to the user.

DESCRIPTION OF A PREFERRED EMBODIMENT

Figure 1:
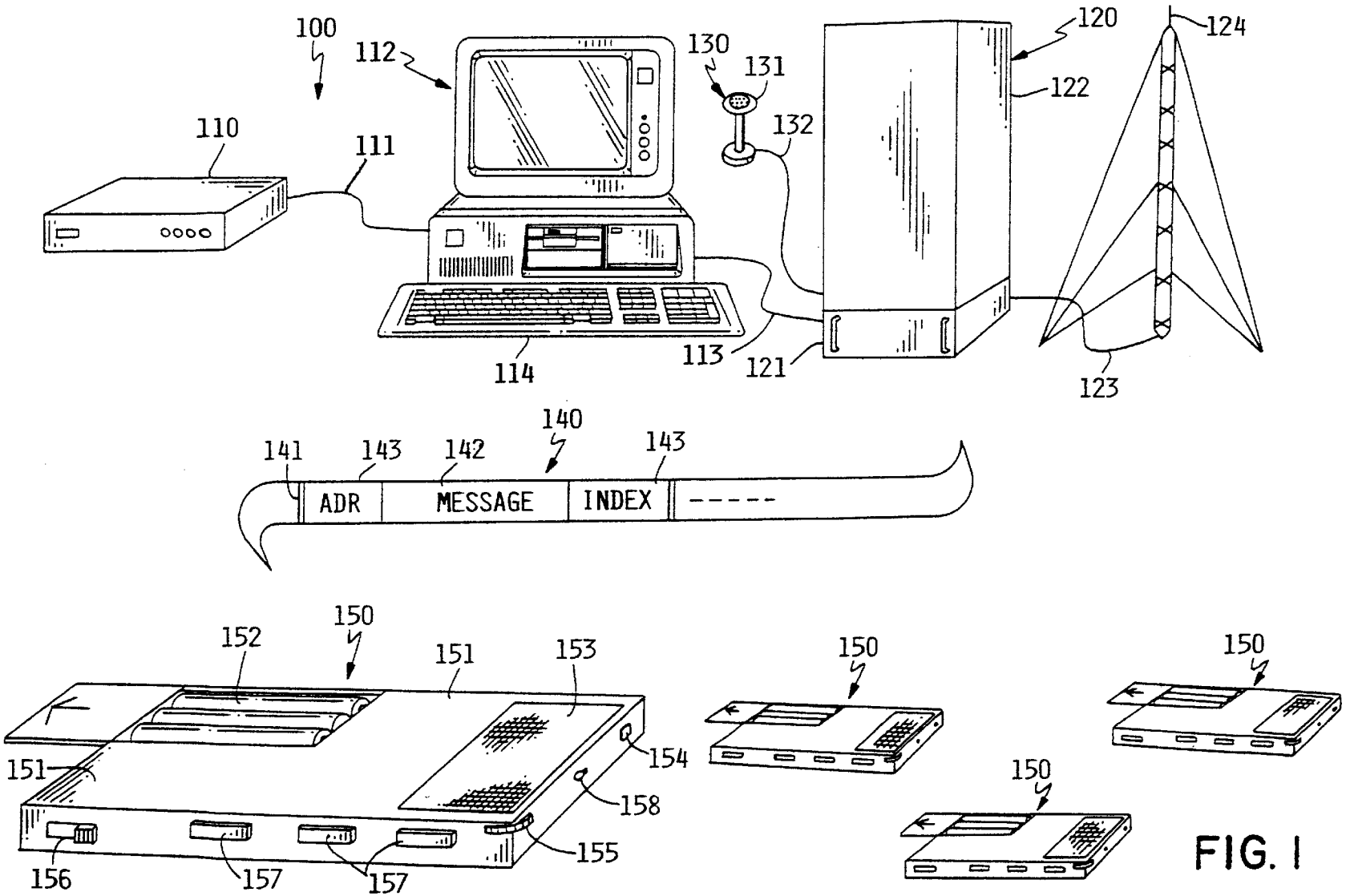
FIG. 1 is a partially schematic representation of a communications system according to the invention.

FIG. 1 illustrates an overall communications system 100 which embodies the present invention. Input device, here shown as a modem 110, represents a source of digitally coded text items, such as news stories. Source 110 could also be a stock-market transaction recorder, or any of a large number of conventional devices which produce text messages, news stories, market information, aviation reports, product announcements, special-interest information, scientific papers, and so on. Instead of providing character-coded text, source 110 could alternatively provide digital codes for speech sounds, music (MIDI) codes, or other types of digital codes. Unit 110 could also represent a large number of such sources, of the same or different types, and could include conventional means—such as a multiplexer —for serializing the items from different sources into a single data stream on an output means 111 such as a cable or microwave feed.

Besides the news items themselves, the present invention could be integrated with a personal mail service for digital messages such as those described in copending application Ser. No. 07/671,329. Such personal mail items can be addressed to an individual user so that only that user can receive the item, by using a unique serial number in each receiver to control reception, as will be described. Likewise, profile items can be transmitted to individual users by the service, for setting or changing the profile of only that one receiver, independently of all other receivers. The broadcast service could also offer optional services at extra charge, just as television cable companies or interactive computer communication services do.

Item stream 140 shows schematically the format of a sequence of text items. Each item 141 has text characters 142 representing the information to be transmitted. Each item also includes one or more text or code characters 143 each representing an index term. (The index terms may alternatively be embedded directly in the information characters 142, either separately marked as index terms, or simply being part of the normal information.)

Finally, each item contains an address block 144. The address block may have two parts, a group address and a device address. The group address specifies certain services, such as personal mail, basic service, a number of predefined interest groups, and separately-charged subscription information services or channels. Each receiver is individually authorized for various services when it is purchased; it can be updated later to allow additional services upon the user's request to the broadcasting company, and can be reset if service bills remain unpaid. The device address is unique to each receiver, in the manner of a cellular telephone. The device address may be employed for personal mail or other items specific to a particular user. A representative address table for a user is shown below.

| GROUP | | UNIQUE | | | | | | (meaning) |
|---|---|---|---|---|---|---|---|---|
| 00 | 00 | 31 | D4 | 48 | 6C | CF | 51 | Received by this user only |
| 00 | 01 | (not applicable) | | | | | | Basic news service |
| 00 | 02 | (not applicable) | | | | | | Financial interest group |
| 00 | 07 | (not applicable) | | | | | | HAL Corp. employees group |
| 80 | 31 | (not applicable) | | | | | | Premium news channel |
| 80 | 34 | (not applicable) | | | | | | NYSE quotation service |
| FF | FE | 31 | D4 | 48 | 6C | CF | 51 | Profile for this user |
| FF | FF | FF | FF | FF | FF | FF | FF | Received by all devices |

(If the major or only use of the text items is for receivers according to the present invention, then the digital codes need not be character codes in a standard set. For example, codes for word parts or speech allophones could be transmitted directly. Special codes for inflection and phrasing could additionally be included. Also, music codes in the standard musical instrument digital interface (MIDI) protocol could be included.)

In a simple broadcast system 100, items could merely be transmitted as they are received from the individual sources. In a more complex scheme, the items could be prioritized. For example, incoming news items could carry an internal priority tag (not shown) along with the text; the transmitting means could then queue up lower-priority items until higher-priority items had been sent. Also, the sender of a personal mail item could pay a rate to the broadcast service for quicker transmission. A base rate, for example, might entitle the sender to have the item transmitted overnight or within 24 hours; a higher rate might guarantee transmission within an hour or within a few minutes; a surcharge might guarantee several repeated transmissions, to increase the likelihood that the mail will be received by the intended user.

Cable 111 routes the digital items from source 110 to computer 112, which may provide optional ancillary functions, such as adding error-correction codes, character-code to phoneme-code translation, or character-code to allophone-code preprocessing on the stream of text items. Such preprocessing may be included to assist the receiving units in their text-to-speech conversion rules, e.g., to distinguish the pronunciation of "-ice" in words such as "office," "vice," and "police." Computer 112 might also process analog speech input to produce digital phoneme codes, as is done in the first stage of conventional speech-recognition products.

Cable 113 couples computer 150 to transmission means 120. In this embodiment, transmission means 120 is a standard commercial FM-band transmitter. Transmitter 120 includes a modulator 121 and a radio-frequency generator 122 for sending a conventional FM signal over cable 123 to an antenna 124. Modulator 122 may also accept an analog or digital signal from another input means 130, as indicated schematically by microphone 131 and cable 132. In a preferred form, source 130 provides standard FM programming to modulator 120, while the modulator produces a conventional SCA subband from the digitally encoded text of source 110. Other SCA services from additional sources also be modulated onto the same FM signal.

System 100 requires input means for each user to specify parameters such as search terms for items of interest, receiver settings, service subscriptions, and so forth. The preferred embodiment performs this function at the transmission end of the system, rather than directly at the receiver. This greatly simplifies the design of the receivers at only a small additional cost at the transmitter. That is, the receivers themselves need contain no keyboard or complicated, expensive interface for entering textual information, or even a maze of buttons or knobs for setting parameters such as speech rate, fast-forward speed, etc. This is practical because the user will only change these parameters infrequently.

The input means shown in FIG. 1 is the same computer 112 described previously. This computer executes a simple program to convert data from keyboard 114 into a profile file having a format to be described, and to send it to the transmitter to be broadcast along with the user's specific address as a profile item. To change a profile, a user may telephone to a central operator for the service, who then enters the profile information into computer 150 from a screen menu (not shown) or other conventional means. Alternatively, the service may allow users to employ their own personal computers, replacing cable 113 with a communications link such as a modem (not shown). The users themselves could then invoke and run their own profile-customizing programs.

Item stream 140 is shown as being broadcast from transmitting antenna 124 to a large number of receiving means 150 simultaneously. That is, the signal from the one central location is dispersed over a wide area, in which any number of receivers may pick it up at any location, without being physically constrained to a particular place or attached at a fixed location.

Receiving means 150 may be similar in many ways to the portable computer devices for audible processing of electronic documents as described in copending commonly assigned application Ser. No. 07/671,329, filed Mar. 19, 1991 by Lemaire et al., which is hereby incorporated by reference. In particular, a receiving device may be constructed in a plastic or metal case 151 small enough to be carried in the hand or in a pocket by an individual user, and powered by batteries 152. (Other versions may be constructed in the form of automobile radios or small desktop units as well.) A small speaker 153 and/or headphone jack 154 provide an audio output to the user directly. A conventional wheel 155 provides a volume control. Power switch 156 turns the unit off and on; in most cases, a portion of the electronics in the case may be left powered on continuously even when the switch is off. Mode-control buttons 157 are placed on the case in such a manner as to be easily accessible to the user, preferably by feel alone; these are constructed similarly to the buttons on a hand-held cassette-tape recorder. That is, the physical size and configuration make receiving means 150 personal to an individual user. Data connection 158 provides a connection for transferring digital data to and from a personal computer, in the manner of conventional hand-held digital computers, calendars, and similar devices.

Figure 2:
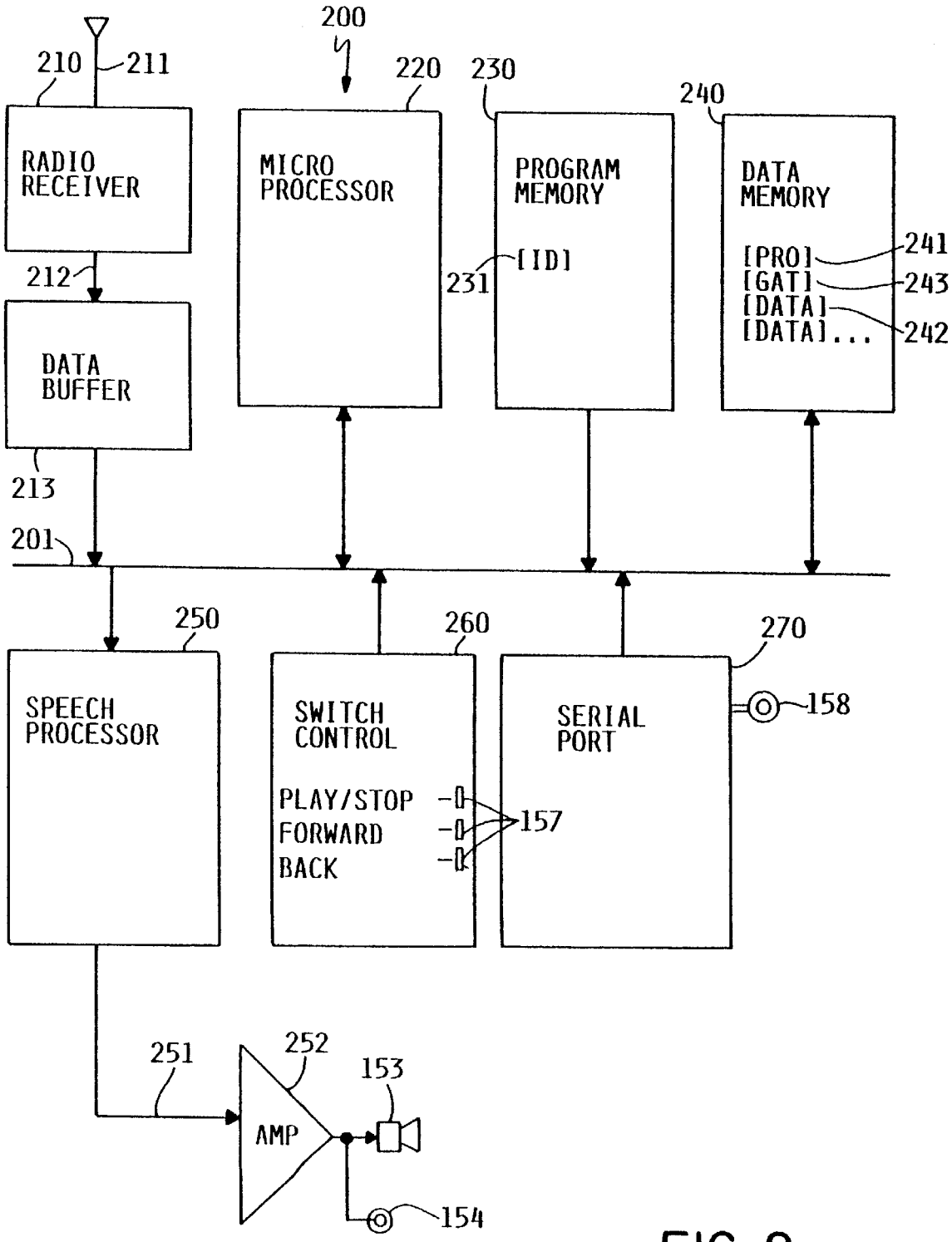
FIG. 2 is a block diagram of a receiver of FIG. 1.

FIG. 2 is a high-level block diagram of receiving means 200, FIG. 1. Radio receiver or demodulator 210 continuously picks up the radio signal broadcast from transmitter 100, FIG. 1, and converts it to a baseband serial digital signal on line 212. Receiver 210 is conventionally available as a single chip which, with the addition of a few components, operates as a complete FM-band radio receiver. A buffer storage 213 converts the serial signal to parallel digital character codes, and provides them to bus 201.

Microprocessor 220 executes programs stored in read-only memory 230, under the control of a conventional real-time event-driven operating system, also stored in ROM 230. ROM 230 also holds an identification serial number 231 which differs for each receiver 200; this serial number uniquely identifies the receiver for purposes explained below.

One of the programs in ROM 230 periodically matches index terms in buffer 213 against a list of terms in a profile file 241 in a data memory 240. When a term in the profile memory matches a term in the buffer, microprocessor 220 passes the entire corresponding item to a text file in data memory 240. A conventional directory file keeps track of the locations and lengths of all files in memory 230. Alternatively, this memory may be organized as a conventional "RAM disk" if desired; then a conventional file allocation table (FAT) holds pointers to the blocks occupied by each file. Another file, a group-address table (GAT) 243, contains a record specifying allowable items for each individual receiver, as will be described. Data memory 240 is preferably a static random-access memory (RAM) backed up by a battery to prevent data loss; alternatives include conventional nonvolatile RAM and "flash" memory.

Data items are stored in a sequence according to predetermined criteria—for example, by priority from highest to lowest, and within each priority by time of receipt. Although the items can be stored randomly in data memory 240, a directory or FAT, as described, contains an ordered index which defines the sequence. This sequence enforces the paradigm of a cassette-tape recorder for the receiver.

Speech processor 250 is preferably a conventional single-chip speech synthesizer for converting digital character codes into an analog signal 251 representing a synthetic voice. Normally, microprocessor 220 executes a text-to-speech program stored in ROM 230 for converting a string of character codes in an item 242 into digital codes representing allophones or other specialized codes; these codes are then gated to speech processor 250 over bus 201. Alternatives include software running entirely in microprocessor 220 which generates a speech waveform directly from character codes via pulse-code modulation or other means with a few external components. (The separation of the text-to-speech converter and the speech synthesizer is an artifact of the technology; the combination of both these units can be called by either name.) Amplifier 252 produces an audio signal strong enough to drive speaker 153, headphones 154, or another audio output device.

Switch controller 260 may be an integrated-circuit register or other interface for the mechanical buttons 157 shown in FIG. 1. In this embodiment, there are three user buttons, labelled PLAY/STOP, FORWARD, and BACK. Microprocessor 220 periodically scans these switches, and executes the appropriate program based upon their state.

A conventional serial port 270 couples bus 201 to data connector 158, FIG. 1. This port may provide readout of items in memory 240 to a personal computer for copying, editing, or printing data items 242, and for other functions which need be performed only occasionally. This connection could also serve to enter or update the receiver's profile 241, if desired.

Figure 3:
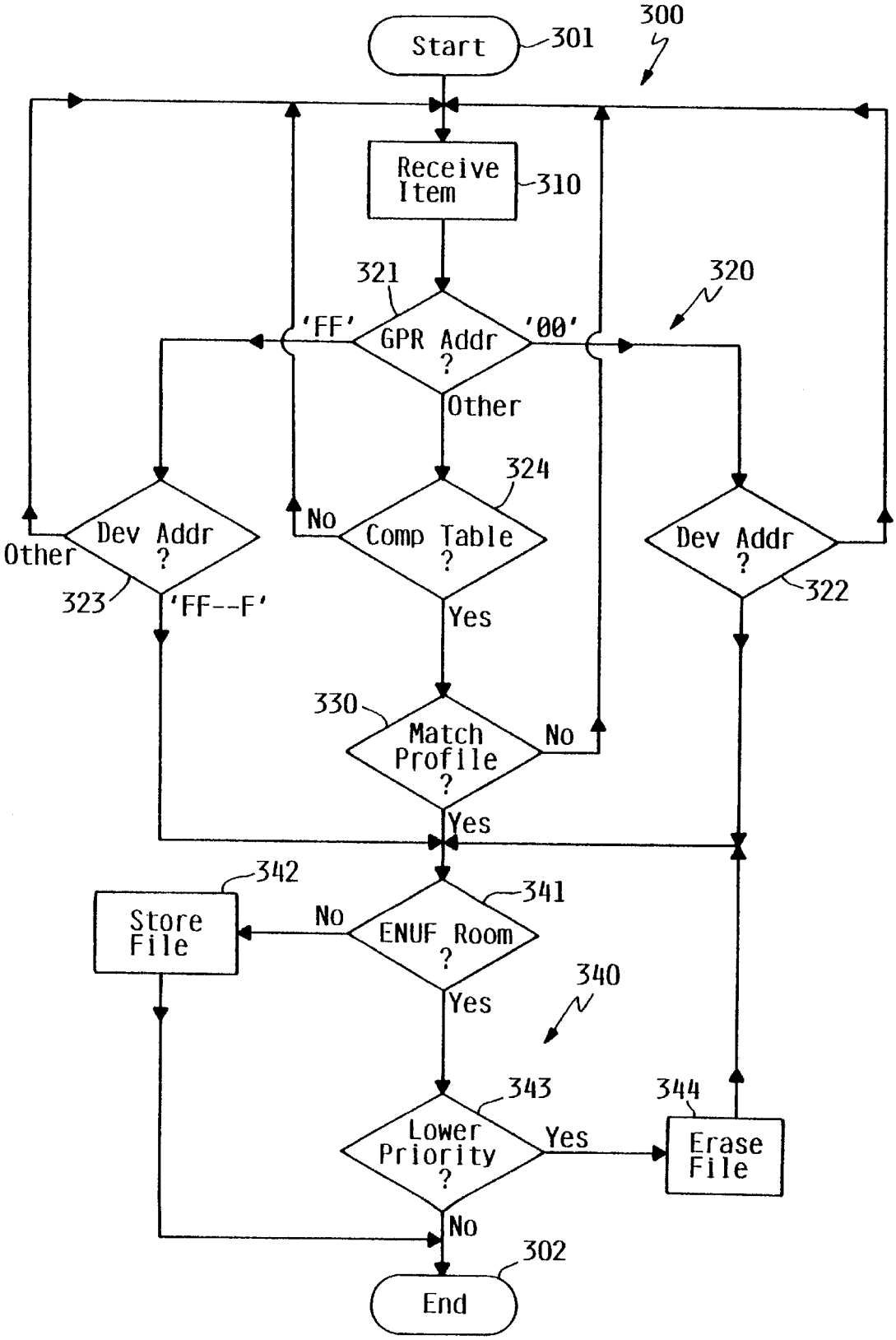
FIG. 3 is a high-level flowchart depicting the overall operation of the receiver of FIG. 2.

FIG. 3 is a flowchart 300 of a program in ROM 230 executed by microprocessor 220 for selecting or filtering received data items according to a user profile for storage in data memory 240. As stated previously, this program may run continuously, even when the receiver power switch is turned off.

First, upon receiving an item 140 at block 310, blocks 320 determine the type of the item. Block 321 compares the group address of the item with its internal address table described above. If the group address is "00 00", block 322 compares the item's device address with the device address 231 in ROM 230, FIG. 2, and selects the item if they match. If the group address and the device address are all "FF" bytes, then blocks 321 and 323 select the item. Otherwise, block 324 checks the item's group address against the entries stored in group-address table 243, FIG. 2, of the receiver. (This table is not directly accessible to the user.) If the group address matches any entry in the table, then block 324 causes block 330 to interrogate the user's profile.

The profile, to be described more fully below, is a data file 241 in memory containing individual fields specifying, inter alia, desired index terms and a priority for each; preferably, the order of the records itself establishes the priority. For example, a profile might contain the following index-term specifications:

| PRIORITY | TERMS |
|---|---|
| 1 | "traffic" |
| 2 | "personal" & "digital" & "assistant" |
| 3 | "pda" |
| 4 | "pen" & "tablet" |
| 5 | "speech" & "synth%" |
| 6 | "subnotebook" & "computer" |

A record may contain a single index term, such as "traffic" in line 1 above. It may also represent that multiple terms must all be present; line 2 requires "personal" AND "digital" AND "assistant" to be all present in the same item. Wild-card symbols may also be included, as in line 5; the "%" sign indicates that any index term starting with the letters "synth" will be accepted. Other combinations and operators may also be used; conventional commercial data bases use many such tools to specify searches. If an index term or combination matches any specification in the profile 241, block 330 selects it for storage.

Blocks 340 control the actual storage of a selected item. If block 341 determines that enough free storage is available, block 342 stores the item as a file in data memory 240; the text of the item is stored, the index terms are stored, and two designated bits, a 'save' bit and a 'delete' bit, are stored in an off state. Otherwise, block 343 asks whether any data files of lower priority are stored. For this purpose, the priority of personal mail items is considered to be higher than that of all news items. All items which have been marked 'save' by the user are given the highest priority, as is the file currently or last listened to; this prevents an item from being erased before the user can mark it. The profile file is never erased except by another profile item. The lowest priority is given to files which have been marked 'delete' by the user; next lowest are the general items (those having an 'FF . . . F' address).

If lower priority files exist, block 344 erases them, and returns to block 341. If insufficient storage can be freed after erasing lower-priority files, block 343 bypasses block 342, and the new item is not stored. End block 302 merely returns to start block 301, so that the cycle 300 repeats.

Figure 4A:
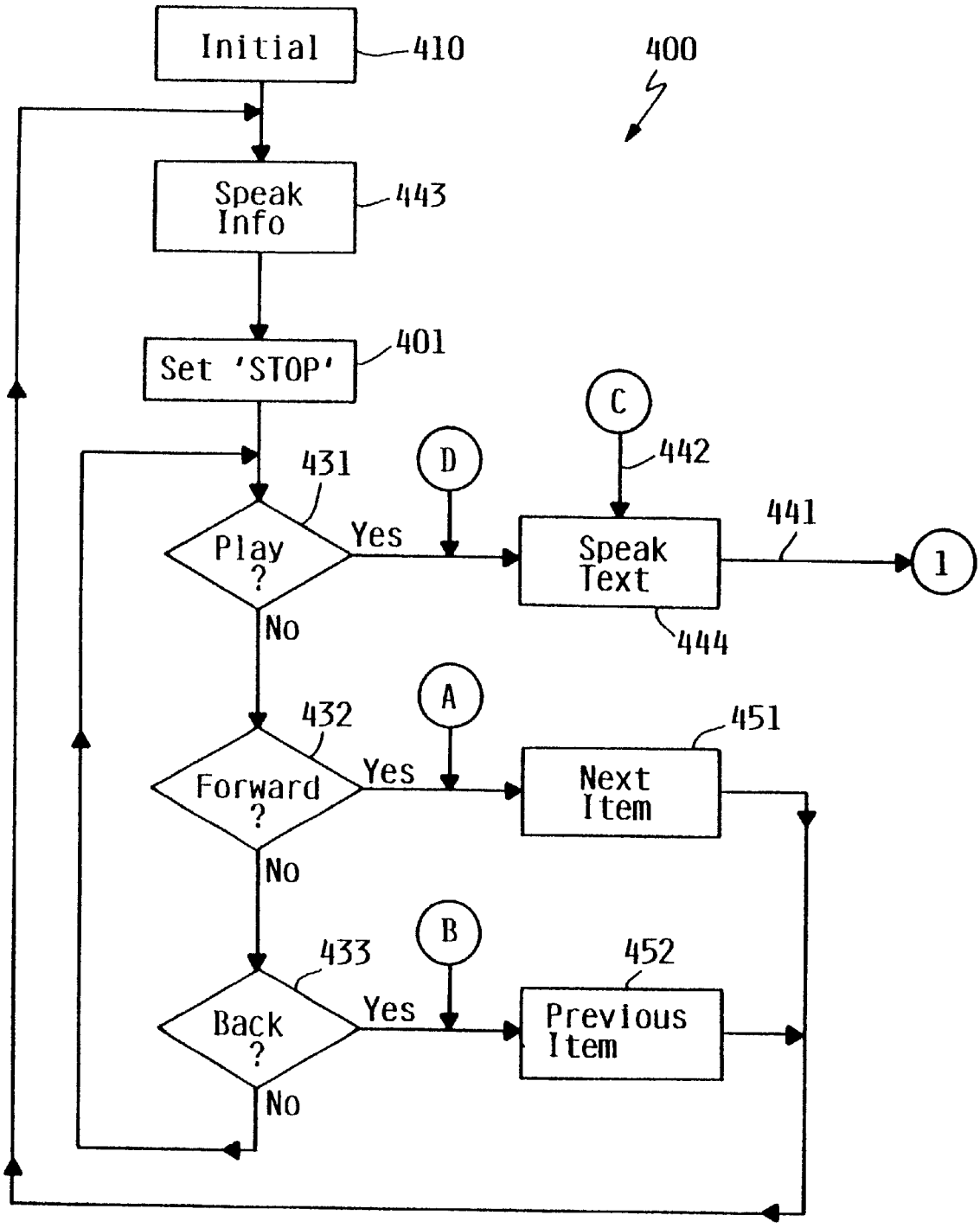
FIG. 4 is a flowchart showing the storage of incoming items in memory.
Figure 4B:
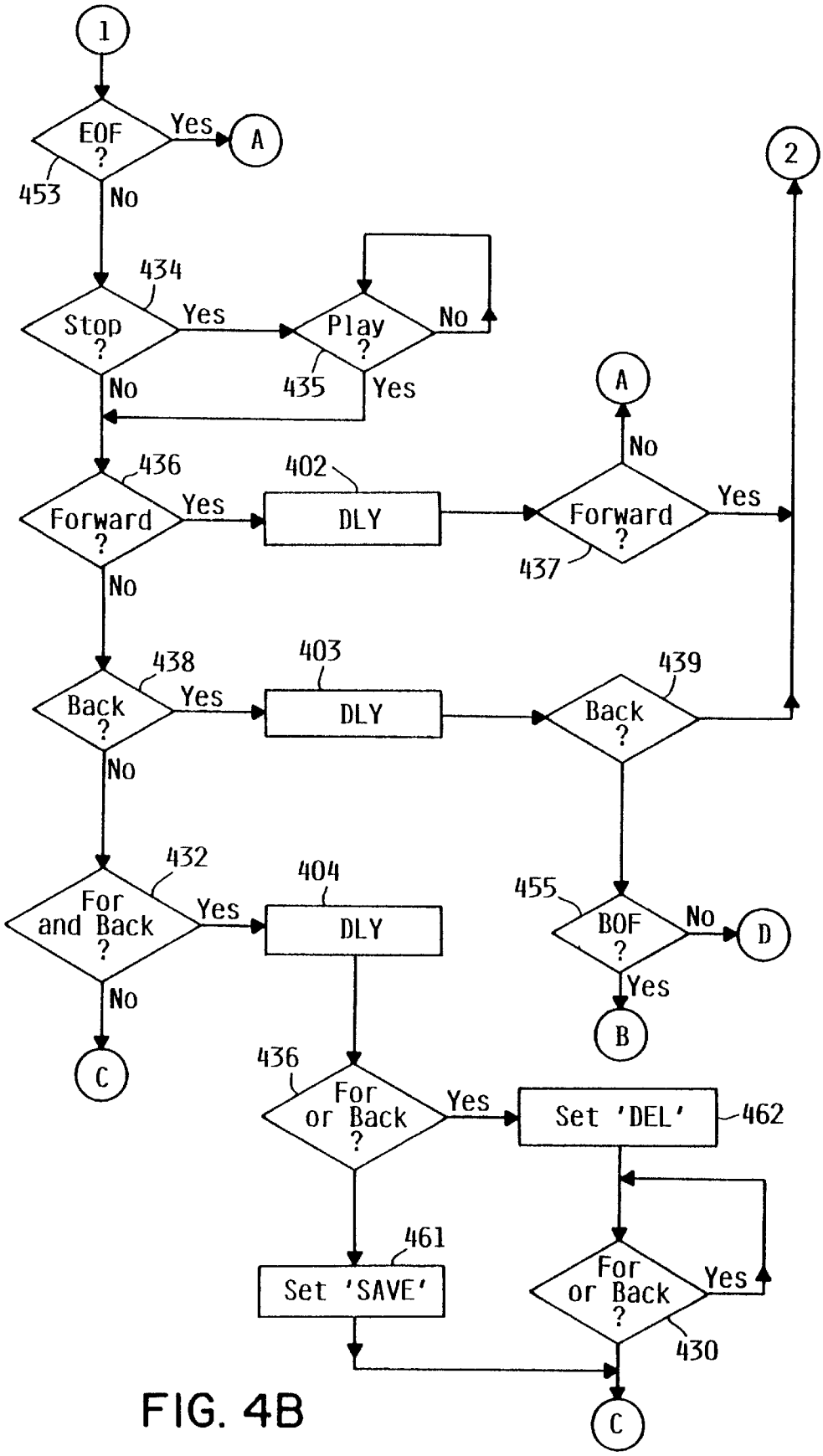
Figure 4C:
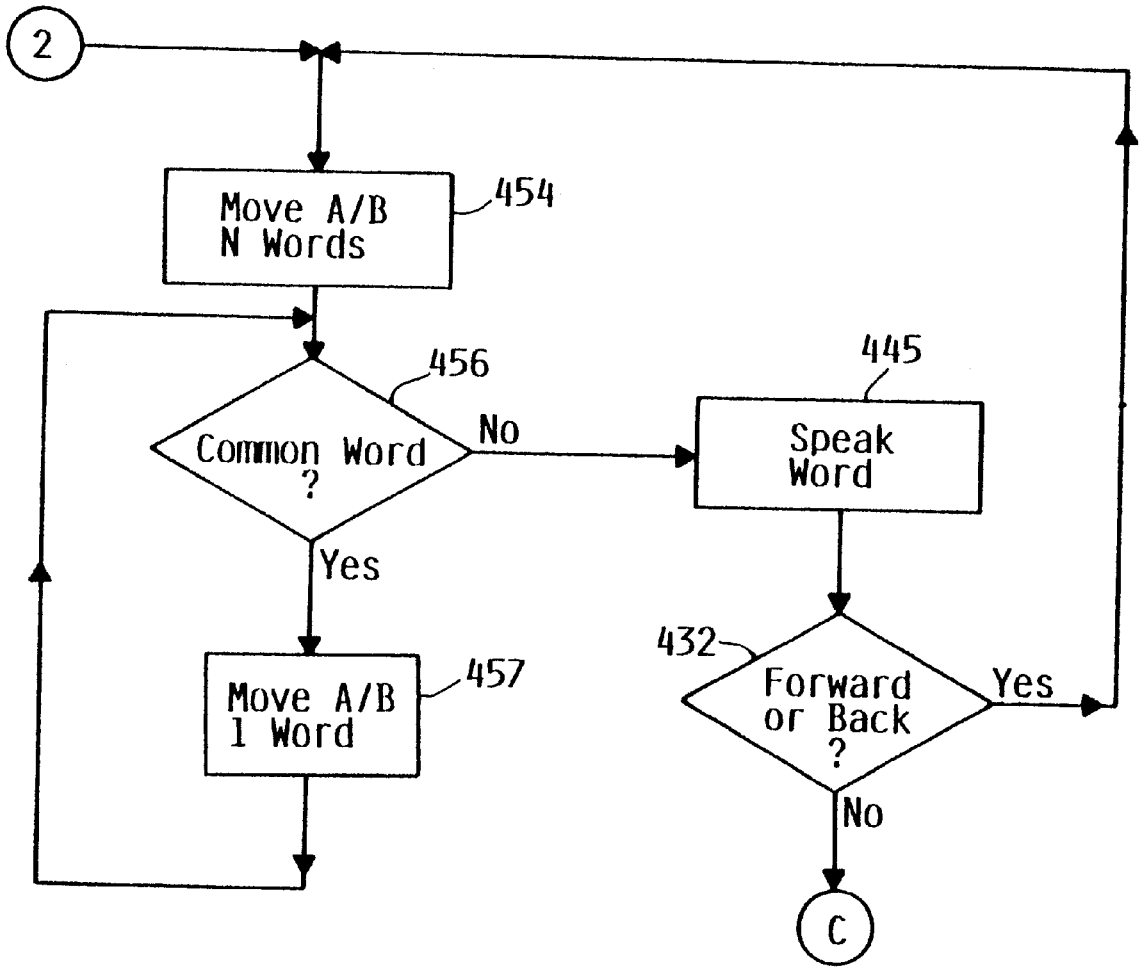

FIG. 4 is a flowchart 400 of a program executed continuously by microprocessor 220, FIG. 2, for controlling the overall operation of the receiver.

Block 410 initializes the receiver. In addition to conventional initialization functions, it speaks a fixed message (such as "Hello") and accesses the current profile in memory, loading parameters and setting pointers from the profile. The profile is a file having a unique name, such as PROFILE.TXT, and a number of individual fields. The table below shows the size and meaning of these fields:

| SIZE | MEANING |
|---|---|
| 1 | Speech rate (1–10 relative) |
| 1 | Speech pitch (1–10) |
| 1 | Fast-forward speed (1–10) |
| 1 | Rewind speed (1–10) |
| 52 | Index to exception dictionary |
| 2 | Length of exception dictionary |
| n | Exception dictionary text |
| 2 | Length of search terms |
| m | Search term text |

The speech-rate parameter sends conventional signals to speech processor 250 specifying how fast the text data is converted into speech; studies show that most people can readily understand speech at a rate two to four times as fast as it is spoken in normal conversation. The pitch parameter causes the processor 250 to produce speech at a frequency most comfortable for the individual user. The fast-forward and backward speed parameters cause the button functions to occur at different rates, as discussed below.

The exception dictionary is similar in operation to user-defined spelling dictionaries in word processor programs. That is, the user can define words in a file in memory which will be pronounced differently than the normal speech-to-text rules would otherwise specify. In effect, the exception dictionary is a text file in memory which operates as additions to the built-in set of pronunciation rules used by the text-to-speech converter program in memory 230, FIG. 2. Although this dictionary could be organized in any convenient manner, this embodiment employs three fields for this file. The index field contains a separate two-byte field containing the offset from the dictionary's beginning to the entries for each letter of the alphabet; i.e., 52 bytes altogether. The length field contains the total length of the dictionary, so that a search routine can jump past it quickly to the search-term fields. The last field contains the text of the dictionary.

The last two fields of the profile file determine the allowable maximum length of the search terms, and their content. Certain symbols are reserved for functional purposes:

| | |
|---|---|
| / | Separates one term or combination from the next. |
| ; | Denotes the end of the list of search terms. |
| & | Requires that multiple terms be present in order to select the item. |
| % | Is a wildcard which represents zero or more following characters. |

Each search term must be enclosed in quotation marks.

Block 443 of text-to-speech conversion blocks 440 then causes speech synthesizer 250, FIG. 2, to recite designated portions of the text of the current item: for example, the type of item, the subject, the length of the item, and the author. Block 420 also marks the directory or FAT entry for this item with a bit designated this item as the "current" item. Control block 401 then sets the Play/Stop toggle to the Stop state.

Blocks 430 scan the state of buttons 157, FIG. 1. In this embodiment, three buttons are available to the user, labelled Play/stop, Forward, and Rewind. The first is a toggle; that is, alternate depressions are "Play," and the remainder are "Stop." The Forward and Rewind buttons can be pressed and released, and can also be held down for a length of time to control further functions. Additionally, multiple buttons can be held down together to engage more operations. The following is a summary of the desired actions of each key and combination:

| KEY NAME | SINGLE PRESS | PRESS & HOLD |
|---|---|---|
| Play(stop) | Speak next item | Speak next item |
| Stop(play) | Stop speaking | Stop speaking |
| Forward | Speak next item | Speak item faster |
| Rewind | Restart this item | Rewind item queue |
| Forward + Rewind | Save this item | Delete this item |

If the user presses the Play/Stop button, block 431 causes block 444 to begin speaking the text of the current item from the beginning. Block 444 periodically exits at line 441 so that other blocks 430 may scan the button states during the time the item is being spoken; if no other action is requested by the buttons, block 444 is reentered at line 442 to continue speaking the current item. Block 444 maintains a text pointer to keep track of which word in the text file is presently being converted to speech.

If the Play/Stop button has not been pressed, but block 432 indicates that the Forward button has been pressed, block 451 of position-control blocks 450 moves the "current" state to point to the stored file for the next item in priority. If instead the Rewind button is pressed, block 432 causes block 452 to move the "current" state to the previous item. In either case, control returns to block 444 to speak the information for the selected item. If none of the buttons are pressed at this point, blocks 431–433 form a wait loop.

During the recitation of the current item by the text-to-speech processor, periodic exit 441 causes block 451 to select the next item when block 453 finds an end-of-file (EOF) character in the current item. If the EOF has not yet been reached, block 434 halts the recitation if the Play/Stop key has been pressed, and resumes when it has been pressed again at block 435.

If the Forward button is pressed at block 436 during the exit 441, delay 402 and block 437 cause block 451 to select the next item as current if this button has been pressed and released within the delay interval. But, if the Forward button is still held down after the delay, control passes to block 454 to initiate faster reading of the text. Pressing and releasing the Rewind button causes blocks 438, 403, and 439 to pass to block 455. If this block senses that the beginning of the file (BOF) for the current item has been reached, then block 452 returns to the previous item. Otherwise, control shifts to block 444 to recite the current item from the beginning, rather than from the point it had reached at exit 441.

If the user presses both the Forward and Rewind buttons together, blocks 43*a*, 404, and 43*b* cause block 461 to set the "save" bit for the current item if the buttons have been released before the delay 404 has expired. Otherwise, block 462 sets the "delete" bit for the item. When block 43*b* or 43*c* indicates that the buttons have been released, control returns to entry 442 of block 444 to continue speaking the current item.

If block 437 or 439 has sensed a press-and-hold of the Forward or Rewind button respectively, then block 454 moves the text pointer kept by block 444 ahead or back in the text file for the current item. The a number of words it is moved is set by the fast-forward and rewind parameters in the profile. Block 456 may move the pointer by one more word at block 457 if block 456 detects that the pointer was sitting at a word having a low information value, such as "a," "or," "the." Block 445 then converts one word at the pointer location to speech. If the button is still held down, block 43*d* repeats the cycle. If not, recitation of the current item continues from entry 441 of block 444.

Having described a preferred embodiment thereof, we claim as our invention:

1. A broadcast communications system, comprising:

at a first physical location, a transmitting means, including a source of digitally coded textual data items, each digitally coded textual data item carrying both digitally coded speech allophone information and special codes for inflection to be transmitted and one or more digitally coded index terms relating to the subjects of that item's information, means for broadcasting said items in a sequence via a transmission medium;

at a plurality of different physical locations, a plurality of receiving means, each operable by a different user, and including detecting means for accepting said sequence of items, profile means for storing a profile comprising certain ones of said index terms selected by said user, said profile being potentially different for each of said receiving means, selection means coupled to said detecting means for passing only certain of said items, said certain items being those having index terms corresponding to those in said profile, memory means coupled to said selection means for storing at least the digitally coded speech allophone information and special codes for inflection of said certain items as said certain items are received, switch means operable by said user for choosing among said items stored in said memory means, and audio conversion means coupled to said memory means and responsive to said switch means for regenerating analog speech signals corresponding to at least the digitally coded speech allophone information and special codes for inflection of each of said chosen items stored in said memory means.

2. The system of claim 1, wherein said transmission medium is radio.

3. The system of claim 2, wherein said means for broadcasting further includes an additional program source, operating independently and in parallel with said source of digitally coded textual data items, and independently of said receiving means.

4. The system of claim 1, wherein said transmitting means further includes input means for entering a profile item, and wherein said broadcasting means transmits said profile item, and wherein one of said receiving means selects said profile item and stores said profile item as said profile for said one receiving means.

5. The system of claim 1, wherein said transmitting means adds an address to each of said items, and wherein said each receiving means contains a list of addresses, and includes means for comparing said item addresses against said list of addresses, and for storing only those items producing a match.

6. The system of claim 5, wherein one of said addresses is unique to said each receiving means.

7. The system of claim 6, wherein one of said items containing said unique address causes said each receiving unit to store said one item containing said unique address in said profile.

8. The system of claim 5, wherein one of said addresses is shared among multiple ones of said receiving means.

9. The system of claim 5, wherein one of said addresses is shared by all of said receiving means.

10. A portable communications receiver for data items, said receiver comprising:

detector means for receiving a sequence of digitally encoded textual data items from a communications medium, each said digitally encoded textual data item having a digitally encoded speech allophone information content, special codes for inflection and one or more index terms representing said content;

profile means for storing a plurality of index terms comprising certain ones of said index terms selected by a user;

selection means coupled to said detector means and to said profile means for selecting only certain of said items, said certain items being those having index terms in said profile means;

data storage means coupled to said selection means for storing at least the digitally encoded speech allophone information content and special codes for inflection of said certain items in a sequence as said certain items are received;

switch means operable by said user for choosing among said items stored in said data storage means; and audio conversion means coupled to said data storage means and responsive to said switch means for generating analog signals corresponding to at least the digitally encoded speech allophone information content and special codes for inflection of said chosen item.

11. The receiver of claim 10, wherein said selected items are stored in a sequence in said storage means, and wherein said switch means includes a plurality of user-operable buttons.

12. The receiver of claim 11, wherein said switch means includes a first button for sending a current item of said items in said sequence to said audio conversion means, a second button for choosing a next item in said sequence as said current item, a third button for choosing a previous item in said sequence as said current item.

13. The receiver of claim 11, wherein an operation of said buttons stops the conversion of said current item to speech.

14. The receiver of claim 11, wherein an operation of said buttons increases the speed of said audio conversion means.

15. The receiver of claim 11, wherein an operation of said buttons returns said audio conversion means to the beginning of said current item.

16. The receiver of claim 11, wherein an operation of said buttons sets an indicator for said current item to prevent the deletion of said current item from said data storage.

17. The receiver of claim 11, wherein an operation of said buttons sets an indicator for said current item to delete said current item from said data storage.

18. The receiver of claim 10, wherein each of said data items further includes an address.

19. The receiver of claim 18, wherein said profile means includes a table of addresses, and wherein said selection means selects only those data items having a data-item address matching one of the addresses in said profile means.

20. The receiver of claim 19, wherein one of said addresses in said profile means is common to all receiving means.

21. The receiver of claim 19, wherein one of said addresses in said profile means is common to multiple receiving means.

22. The receiver of claim 18, wherein said receiver means further comprises a unique identification address different from that of all other receivers.

23. The receiver of claim 22, wherein said selection means also selects those of said data items having said unique identification address.

24. The receiver of claim 22, wherein one of said data items is a profile item, and wherein said selection means selects said profile item and stores said profile item as said profile means.

25. The receiver of claim 10, wherein said profile means includes means for specifying certain operational parameters of said receiving means.

26. The receiver of claim 25, wherein one of said parameters determines a pitch for said audio conversion means.

27. The receiver of claim 25, wherein one of said parameters determines a speaking rate for said audio conversion means.

28. The receiver of claim 25, wherein said profile contains additional pronunciation rules for said audio conversion means.

29. The receiver of claim 10, wherein different ones of said data items include different priorities.

30. The receiver of claim 29, wherein said items are arranged in said sequence according to said priorities.

31. The receiver of claim 30, wherein said switch means chooses said items in sequence by priorities.

32. The receiver of claim 10, further including control means coupled to said audio conversion means for speaking status information concerning said sequence of stored data items.

33. The receiver of claim 32, wherein said control means speaks the number of said data items stored in said data storage means.

34. The receiver of claim 32, wherein control means speaks the index terms of at least one of said stored data items.

* * * * *